US005122624A

United States Patent [19]

Benda

[11] Patent Number: 5,122,624

[45] Date of Patent: Jun. 16, 1992

[54] CIRCUIT BREAKER BLOCK OUT

[76] Inventor: Steven J. Benda, P.O. Box 782, Cokato, Minn. 55321

[21] Appl. No.: 644,554

[22] Filed: Jan. 23, 1991

[51] Int. Cl.[5] ..... H01H 9/28

[52] U.S. Cl. ..... 200/43.14; 200/43.15; 200/43.16

[58] Field of Search ..... 200/43.14, 43.15, 43.16, 200/43.11, 43.19, 43.21; 70/DIG. 30

[56] References Cited

U.S. PATENT DOCUMENTS

| | | | |
|---|---|---|---|
| 2,807,692 | 9/1957 | Leslie | 200/43.21 |
| 2,937,248 | 2/1959 | Michetti | 200/43.21 |
| 4,347,412 | 8/1982 | Mihara et al. | 200/43.15 |
| 4,467,152 | 8/1984 | Gordy | 200/43.15 |
| 4,677,261 | 6/1987 | Nourry | 200/43.15 |

*Primary Examiner*—Henry J. Recla
*Assistant Examiner*—David J. Walazak
*Attorney, Agent, or Firm*—Paul H. Gallagher

[57] ABSTRACT

A one-piece molded plastic item, having an original and unfolded condition, and foldable into the double condition, and having ribs and channels on one surface in the unfolded condition which interface in the folded condition and form recesses for receiving the actuating lever of a switch. It has locking pins entering into holes in the switch lever. The recess is at an angle corresponding to that of the switch lever, and a binding effect is produced between the recess and switch lever. The folded halves of the item produce a self-locking effect. A second form can be applied to a plurality of side-by-side switches, but is not folded but receives the switch levers in recesses.

15 Claims, 2 Drawing Sheets

Fig. 2
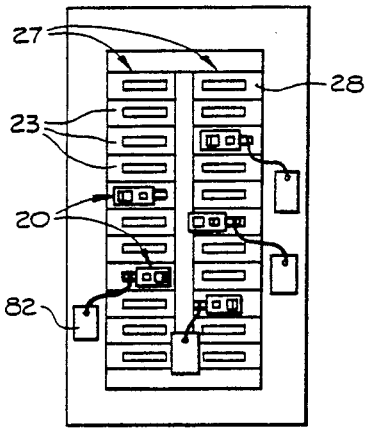
Fig. 1
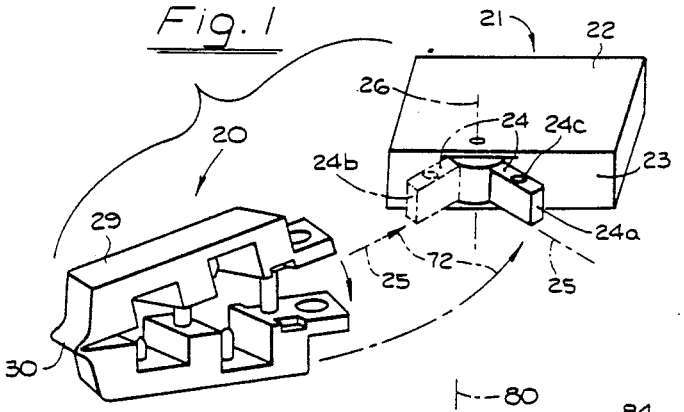
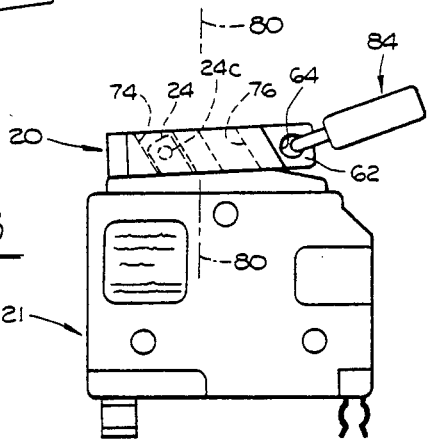
Fig. 3
Fig. 4
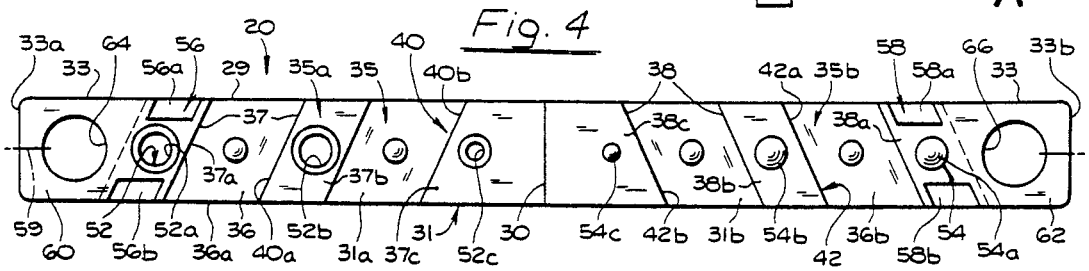
Fig. 5
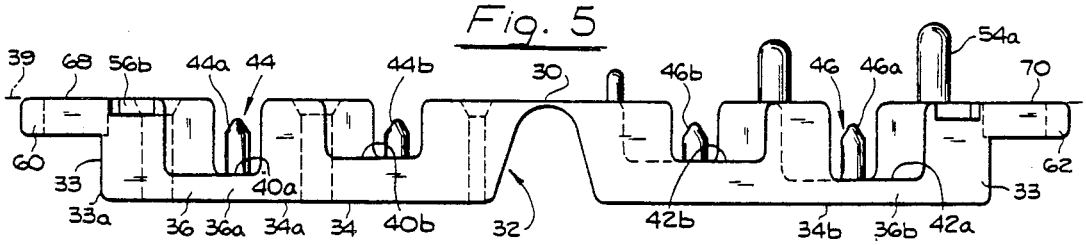
Fig. 6
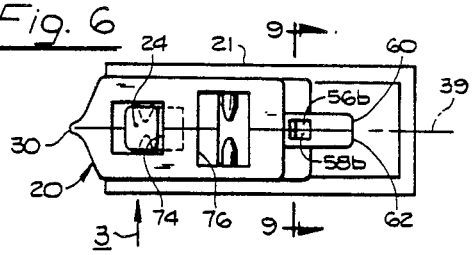
Fig. 7
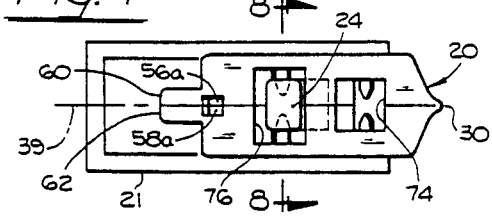

BOTTOM

TOP

CIRCUIT BREAKER BLOCK OUT

BRIEF SUMMARY OF THE INVENTION

The invention resides in the field of controlling circuit breakers in an electrical system, and more specifically, to block out a circuit breaker in the open position. This is a great factor in working on or around energized components and equipment where the associated circuits are required to be de-energized. Heretofore this step was effected by opening various individual circuit breakers. Opening the main breaker is generally resorted to for the purpose, but a drawback is present in that case in that associated circuits are de-energized that need not be de-energized for the immediate functions to be carried out, and thus do not provide selectivity. It is and always has been desired that only circuit breakers be opened selectively, and heretofore this was most often done by taping them in open or off position, but this step was cumbersome.

A main object of the present invention is to provide a circuit breaker block out that overcomes the disadvantages set out as indicated above, and provides means for selectivity, and easily blocking out individual circuit breakers.

Another object is to provide a circuit breaker block out of the foregoing character, having the following features and advantages:

1. It is extremely simple, being of one-piece construction, of molded material (plastic), and capable of being made in great quantities rapidly.

2. It can be easily applied to the circuit breaker by a workman, simply and quickly, manually and without tools.

3. It is of one-piece construction, self-contained, separate and independent of the circuit breaker in the desired position (open or OFF), and without the requirement of extraneous elements, although extraneous elements may be utilized when desired.

4. It has novel and convenient means and arrangement of elements for applying tags bearing notices and warnings, and locks.

The device of the invention assumes two forms, one specially adapted to a single circuit breaker, and another adapted to a plurality of circuit breakers that are ganged together.

BRIEF DESCRIPTION OF THE SEVERAL VIEWS OF THE DRAWINGS

FIG. 1 is a perspective view showing the block out in a position just before being fitted to the circuit breaker.

FIG. 2 is a face view of an assembly panel including a number of circuit breakers and showing block outs applied to certain ones thereof.

FIG. 3 is a view oriented according to the arrow 3 of FIG. 6, with the block out applied.

FIG. 4 is a face view of the block out in original open and extended form.

FIG. 5 is a side view of the device taken from the bottom of FIG. 4.

FIG. 6 is a view of a block out in folded form and applied to the circuit breaker.

FIG. 7 is a view similar to FIG. 6 but in an opposite position.

DETAILED DESCRIPTION

Figure 8:
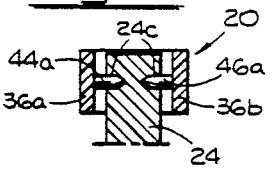
FIG. 8 is a sectional view taken at line 8—8 of FIG. 7.
Figure 9:
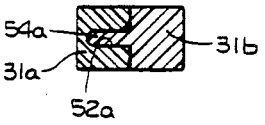
FIG. 9 is a sectional view taken at line 9—9 of FIG. 6.

Reference is first made to the form of the device illustrated in FIGS. 1–10, which is the form used in connection with a single circuit breaker or switch.

Referring to FIG. 1, the block out, identified at 20, is shown with a circuit breaker with which it is to be used, and for facilitating the description of the device, a brief description of the significant elements of the circuit breaker is made here. The circuit breaker is shown in its entirety at 21. It is also known as a circuit breaker switch, and in the trade it is also often referred to simply as a switch, and the latter designation will be used herein at times, for convenience. The circuit breaker 21 is of known kind and includes a body 22 having a front panel or surface 23. It includes an actuating lever or tongue, 24 movable between opposite positions shown, i.e., OFF position **24*a* shown in full lines and an ON position 24*b* shown in dot-dash lines. Holes 24*c* are also provided in the lever. The lever has a length direction indicated by the axis 25, and is mounted for swinging movements on a transverse axis 26. Such circuit breakers or switches are often mounted in an assembly indicated at 27 in FIG. 2, in side-by-side relation forming a main front panel 28 in the assembly, made up of the front panels 23 of the individual switches. The switch 21 as shown in FIG. 1, and the assembly of switches in FIG. 2 are positioned with the front panels 23 in the main front panel 28** in a vertical position, di-directed toward the observer. It will be understood that the switches may be mounted in any desired position and the block out is applicable thereto in any of such positions.

The block out 20 is a single one-piece, integral member 29 which is a molding of plastic, preferably polypropylene, although the invention is not limited to this specific material. The plastic material used is generally rigid, i.e., not easily flexed at points where it is of substantial thickness, and it is incompressible, so that if a dimension is changed at one point, a corresponding change in dimension is produced at another point. However, the material has a limited degree of flexibility as will be referred to in the locking steps referred to hereinbelow, and it is constructed with a small dimension hinge, described hereinbelow, which permits great flexibility at that point.

The member 29 (FIGS. 4 and 5) includes a hinge element 30 at a central position, of small thickness providing the great flexibility referred to above, and utilized in folding the member to its locking position. The member includes, on opposite sides of the hinge, two main parts 31, individually identified **31*a*, 31*b*, and at the hinge is a gap 32** faced by end surfaces of the main parts. These main parts are foldable or swingable about the hinge, and have ends 33, individually identified 33*a*, 33*b* which may be referred to as remote ends, extended ends, or swinging ends.

The member 29 has a back side 34, the portions thereof in the two main parts being individually identified 34*a*, 34*b*; it has a front face 35 forming mating surfaces, the portions in the two main parts being individually identified 35*a*, 35*b*.

The member 29 includes a continuous strip 36 in each main part which may also be referred to as a backbone, or body, having two parts 36*a*, 36*b* in the respective main parts of the member.

The member has, in its front face or mating surfaces, ribs or lands 37 on one of the main parts, individually identified 37*a*, 37*b*, 37*c*, and ribs or lands on the other main part individually identified 38*a*, 38*b*, 38*c*.

The ribs 37, 38, between adjacent ones thereof, form channels or grooves, those on one of the main parts designated 40 and individually identified 40*a*, 40*b*, and those on the other main part designated 42 and individually identified 42*a*, 42*b*.

At the front, or extended, ends of the ribs 37, 38, i.e., in direction away from the continuous strips 36, the ribs have extended surfaces lying in a plane 39 (FIG. 5) which is common to all the ribs when the member is in the original unfolded and open form. When the member is folded, as described below, these mating surfaces on respective ribs interengage, relative to the two main parts of the member (FIGS. 6, 7).

In the folded position or condition of the member, in addition to the ribs 37, 38 mating, the respective channels 40, 42 interface to form angular recesses for receiving the actuating lever or tongue of the circuit breaker, as referred to again hereinbelow. The respective channels are of different depths, i.e., in direction from back to front, and specifically the channels 40*a*, 42*a* are of the dame depth, but deeper than the channels 40*b*, 42*b*, the latter two being of the same depth.

Positioned in the channels, in one of the main parts, are locking pins 44, individually identified 44*a*, 44*b*, and in the other part, locking pins 46, individually identified 46*a*, 46*b*. These locking pins extend from the continuous strip 36*a*, 36*b*, are of respective lengths that their extended ends terminate at approximately the same level (FIG. 5) throughout the unfolded member. Preferably these locking pins are tapered for facilitating insertion of them into holes in the actuating tongue of the switch, for locking purposes as referred to again hereinbelow.

The member includes locking elements for locking the two main parts together in folded position, including three holes or female elements 52, on one of the main parts, individually identified 52*a*, 52*b*, 52*c*, and elements forming male elements 54 in the other main part, individually identified 54*a*, 54*b*, 54*c*. The holes 52 are formed in the corresponding ribs and open through the ribs at the front ends of the latter, i.e., in the plane 39. They also extend through the member, for facilitating molding and to provide venting for insertion thereunto of the elements 54. The holes 52*a*, 52*b*, 52*c* are progressively of lesser width or diameter, and they may be counterbored for facilitating entrance thereinto by the elements 54.

The elements 54*c*, 54*b*, 54*a* are of progressively greater lengths, and of progressively greater thickness or diameter, corresponding with respective ones of the holes 52.

Additional conformations in the member include notches 56, individually identified 56*a*, 56*b*, in one main part (left end, FIGS. 4, 5) and notches 58 individually identified 58*a*, 58*b* in the opposite end of the member. These notches respectively interface or register in the folded condition of the member (FIG. 6, 7).

It will be noted that the ribs 37, 38, and the channels 40, 42 formed thereby, are disposed at acute angle, or inclined relative to the central longitudinal axis 59 of the member (FIG. 4), to accommodate the inclination of the switch actuating lever, as referred to again hereinbelow.

Additionally the member includes lugs 60, 62 at respective ends of the member, having holes 64, 66 therethrough. These lugs have front faces 68, 70 (FIG. 5) and are so positioned on the member that these front faces lie in the common plane 39, and thus form extensions of the mating surfaces of the main parts of the member.

To apply the block out to the switch, it is held first as oriented in FIG. 5, and bent by swinging the two main parts about the center hinge 30, to a position approximately that shown in FIG. 1, and then moved bodily to the switch 21 as indicated by the arrows 72, fitted to the switch and then after being so fitted, the two parts are squeezed together and locked.

In folding the two parts together, the channels 40*b*, 42*b* interface, as stated, and together form an angular recess 74 (FIG. 6, 7), and similarly the channels 40*a*, 42*a* interface and form another angular recess 74. From FIG. 5, it will be noted that the respective channels are of different depths, the two shallower ones interfacing and forming the recess 74 which is thereby of lesser width, and the two deeper channels 40*a*, 42*a* interfacing and forming the recess 76 which is wider. These narrower and wider dimensions of the angular recesses are provided to accommodate switch actuating levers of correspondingly different widths.

FIG. 3 is referred to in connection with FIG. 6; FIG. 6 is oriented according to FIG. 5, and FIG. 3, as noted, is a view from the bottom of FIG. 6 as indicated by the arrow 3. FIG. 3 is a side view relative to FIG. 6 and indicates the angular recess 74 and the lever 24 therein. Both these figures show the inclination of the angular recess and lever which as viewed in FIGS. 6 and 3 is up and to the left. In FIG. 3 the arrangement represents the lever as being narrow and thus fitted in the narrow recess 74. However in the case of a larger switch, in which the switch lever is wider, the wider recess 76 will be utilized.

After the block out is so fitted to the switch in which it is oriented generally as in FIG. 1, it is then squeezed and snapped to closed position, and in this last step, the locking pins 44*b*, 46*b* (FIG. 5), are inserted into the holes 24*c* in the switch lever (FIGS. 3, 6, 8). These locking pins, 44*b*, 46*b* are centered longitudinally of the recess, i.e., left-to-right, FIG. 4, and the lever of the switch is narrower in that direction than the recess, and accordingly the block out is positioned with more space on the corresponding side thereof, namely, on the left hand side as viewed in FIGS. 6 and 3. If it is desired to have this extra space on the opposite side of the lever, the block out is rotated end-for-end 180° about the axis 80 (FIG. 3) to the position shown in, FIG. 7 in which the lever and recess are angled in the opposite direction, i.e., up and to the right.

In the case where the switch lever 24 is wider than the recess 74 can accommodate, the block out is applied so that the lever is received in the wider recess 76 instead, and the other steps in applying the block to the switch are the same as described above.

Figure 10:
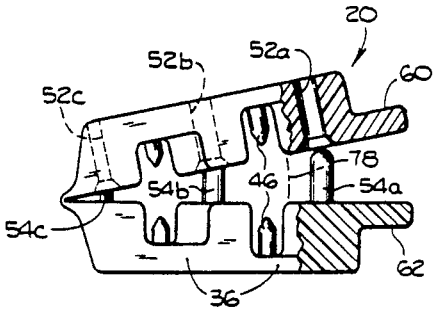
FIG. 10 is a semi diagrammatic view of the block out in a position just before being fully folded to operable position.

In so applying this block out to the switch, it is pointed out that the locking elements 54 are rigid and extend perpendicularly from the body of the block out. The holes also extend perpendicularly and the elements and holes are dimensioned to provide a friction fit (FIG. 9) tending to prevent unlocking of the block out. Because of this perpendicular relation, the elements or corresponding portions of the backbone, or both, are flexed or bent, enabling the elements to enter into the holes notwithstanding the relative arcuate movement therebetween, as indicated at 78 (FIG. 10). This relationship between these elements and holes tends to prevent unlocking of the blocking member.

To facilitate unlocking of the blocking member, the notches 56, 58 are provided, and respective ones of these mate or interface (FIGS. 6, 7), forming recesses for receiving a screw driver or other tool for prying the parts apart to an unfolded position.

While the block out has an interlocking relation to the switch lever, it does not have mechanical locking to the body of the switch. The block out has substantial dimension in longitudinal direction (left-right, FIGS. 3, 6, 7), and any tendency to move it in that direction for actuating the lever is reduced and effectively completely blocked. Because of the swinging movement of the lever about the axis 26 (FIG. 1), the holes 24*c* therein coupled with the locking pins 44*b*, 46*b* prevent the block out from moving away from the front panel 28 or 23 (FIGS. 1 and 2). With the block out locked onto the switch lever, movement is prevented by the binding action between the acutating lever and the surfaces of the angular recess, and hence an effective locking condition is provided to the switch lever position.

The lugs 60, 62 and holes 64, 66 provide a means for tying a tag 82 (FIG. 2) thereon which may bear a notice or a danger sign. These lugs as noted above are in interengagement in the locked condition of the block out, and enable additional locking means 84 such as a padlock (FIG. 3) to be secured therein, which provide locking in addition to the locking effect described above, where extraordinary security may be desired or required according to prevailing safety regulations.

Figure 11:
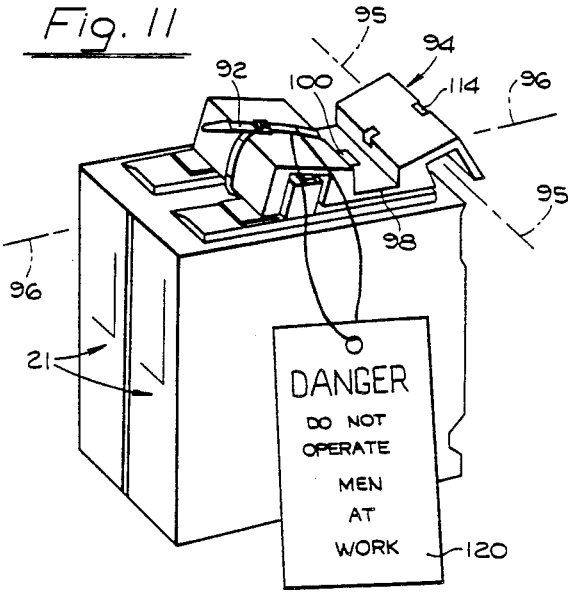
FIG. 11 is a perspective view of another form of block out, utilized for a plurality of ganged circuit breakers, and applied to those circuit breakers.
Figure 12:
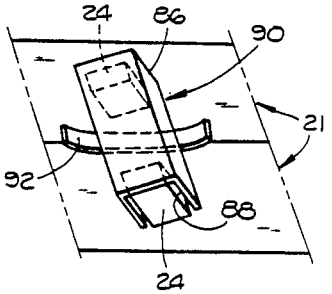
FIG. 12 is a fragmentary perspective view of the portion of the circuit breakers under the block out, of FIG. 11.
Figure 15:
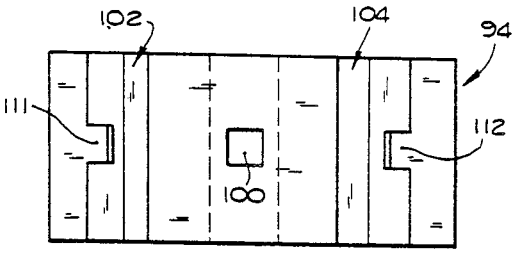
FIG. 15 is a bottom view of the block out of FIG. 11.
Figure 14:
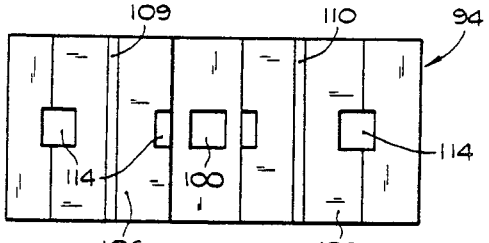
FIG. 14 is a top view of the block out of FIG. 11.

Reference is now made to the form of device illustrated in FIGS. 11–15. In many instances, where circuit breakers are arranged in groups, it is desired that when one portion of the circuit controlled by one circuit breaker, is out of commission, associated circuit portions be opened or disabled. In such instances a tie bar or clamp-on bar is utilized. FIG. 12 shows two circuit breakers or switches 21 having actuating levers or tongues 24. A tie bar 86 of known kind is utilized. This tie bar 86 is shown somewhat diagrammically, and basically is in the form of an inverted channel 88 fitted over the actuating levers of the several switches involved, and is held or locked thereon in a known manner not pertinent in the present instance. The tie bar when so utilized is spaced from the front panel of the switches, providing an opening or hole 90 between itself and the switches receiving a tie 92 in the form of a strap, referred to hereinbelow.

The block out of this form (FIGS. 11–15) indicated at 94 is also a single molded, one-piece member separate from and independent of the circuit breakers or switches themselves. This block out has a length dimension along the axis 95 and a width direction along the axis 96. It is of a length appropriate to extend over the number of switches affected, in this case two, and includes a center element 98 at the bottom which is relatively thin and correspondingly flexible. It also includes a center aperture 100.

Figure 13:
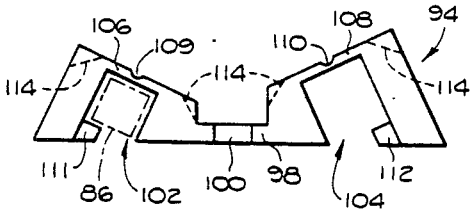
FIG. 13 is a side view of the block out of FIG. 11.

At the ends it includes recesses 102, 104 which extend through the device, in the direction of the axis 95, opening at opposite sides thereof, and are angled upwardly and toward each other (FIG. 13). These angular recesses are of different widths to accommodate the actuating levers of different dimensions.

These recesses are defined at their closed ends by relatively thin elements 106, 108 which are flexible, and formed in the outer surfaces of these elements are grooves 109, 110 which extend the full length of these elements, i.e., the full length of the recesses, and which provide greater flexibility at their locations, as referred to again hereinbelow.

Formed at the open faces of the recesses are projections 111, 112 on the opposite surfaces of the recesses relative to each other and extending toward each other.

The block out also is provided with indentations 114 at various external locations for receiving the tie 92 (FIGS. 11, 12). The block out of this form is applied to the switches by fitting it thereto, directly against their face, and fitting over the tie bar 86 which would then be over the actuating levers of the switches, in the one recess selected, according to the dimension involved: in the illustrations, it is the left hand one of FIGS. 11, 13. To so apply it, the user flexes the member about the thin portion 106 in such direction as to form a concave surface thereon on the top. This withdraws the projection 111, and enables the block out to be fitted as referred to, and then the device is released, and the left hand portion resumes its normal position and, thereby the locking projection 111 moves into the hole or space 90 (FIG. 12) locking the block out on the gang switch assembly.

The block out has a normal straight or flat position as represented in FIG. 13, and after it is applied as just referred to, it assumes that position and the under surface fits on and against the front panel of the switch throughout its own length.

After the block out is so applied, the tie 92 is applied, by inserting an end through the center aperture 100, then through the hole 90 under the tie bar, and the ends are brought around and over the top of the corresponding portion of the block out and interconnected (FIG. 11),fitting in the indentations 114.

Referring again to the thin portions 106, 108, it sometimes occurs that convenient space does not exist for accommodating the complete block out, and in that case the excess portion according to the position of the applied block out, e.g., the right hand end FIG. 13, can be swung upwardly about the groove 110 which readily accommodates that movement to an upper position, this end of the block out in that condition then not functioning. It may be desired even to cut off the extended end portion and that may be done easily by cutting along the groove.

The tie 92 provides a convenient means for hanging a tag 120 which contains a notice or warning.

The tie 92 locks the block out securely to the switches to provide the desired security according to prevailing practices and regulations.

All of the recesses 74, 76, 102, 104 are open-ended, that is, they do not have walls extending across the ends thereof which would prevent flexing of the thin portions referred to in bending the respective block out.

The device of FIGS. 1–10 can be bent in selected different position according to the location of the switch, and the position in which the switch lever is to be locked, by swinging or rotating the block out about the axis 80 (FIG. 3) and/or the axis 59 (FIG. 4).

I claim:

1. A block out for use with a switch having a front panel presented to a user, and having an actuating lever exposed through the front panel and thereby accessible for actuation by the user, and swingable on an axis adjacent to the front panel, between opposite positions spaced apart angularly, comprising, an elongated one-piece member with a reduced portion at the middle forming a hinge, the member thereby having two main parts on correspondingly opposite sides of the hinge, the opposite parts having front faces, forming complementary mating surfaces, the members being foldable about the hinge into a position in which the said mating surfaces interengage, the mating surfaces having conformations which, when the member is so folded, form angular recesses, the member being so foldable about the switch lever with the switch lever between said mating surfaces and positioned in one of the recesses, and with the mating surfaces in interengagement, and the member being thereby fitted to the switch, the member when so fitted to the switch being in loose and non-locking engagement with the front panel, and being in locking engagement with the lever, and thereby being capable of preventing movement of the lever from its said one position toward its opposite position.

2. A block out according to claim 1 wherein, said conformations are so shaped that the said recess extends through the member, whereby the member can be fitted to the switch lever in either of opposite positions determined by rotation of the member about an internal longitudinal axis, said recesses being so shaped that they can be seen through.

3. A block out according to claim 1 wherein, the angular recess has a major dimension corresponding with the width of the switch lever, which, when the member is fitted to the switch lever, extends essentially parallel with the front panel and lies in a plane between the main parts.

4. A block out according to claim 1 wherein, at least one of said main parts of the member has, at an end remote from the hinge, an apertured lug for tying a tag thereto.

5. A block out according to claim 1 wherein, the hinge extends transversely of the member and the two main parts are also elongated, each of the main parts has an apertured lug at an end remote from the hinge and adjacent the corresponding front face, and the lugs being in register when the member is in folded position enabling the insertion of a securing tie or locking mechanism therethrough, rendering the block out in a folded and mated configuration.

6. A block out according to claim 1 wherein, the member is made of material that is generally rigid but possesses a limited amount of yieldability, said front surfaces having conformations which, when the member is so folded, form locking elements, said locking elements include male and female elements extending from and into respective front faces, and interengageable when the main parts are in folded position, and extending in such direction relative to movement of the main parts toward and from their said folded position, as to produce a binding effect therebetween and impede movement of the main parts from each other.

7. A block out according to claim 6 wherein, the male elements are of progressively greater length from the hinge toward the respective ends of the main parts.

8. A block out according to claim 7 wherein, the male and female elements are of progressively greater width in the directions stated.

9. A block out according to claim 6 wherein, certain of said conformations form, when the main parts are in folded position, notches for receiving a tool for prying said main parts out of folded position.

10. A block out according to claim 1 wherein, said conformations include ribs and channels, the channels on the opposed main parts interengaging and the channels facing when the main parts are in folded position, and the channels being spaced apart and thereby forming said angular recesses.

11. A block out according to claim 10 wherein, said locking elements include male and female elements extending from and into the ribs on the respective mating surfaces, and interengageable when the main parts are in folded position.

12. A block out according to claim 10 wherein, said locking elements include pins extending from the floors of the angular recesses and, when the main parts are in folded position, those pins in the interfacing angular recesses are extendable into holes in the switch lever for locking the member to the switch lever.

13. A block out according to claim 10 wherein, the ribs and channels are disposed at an inclined angle relative to a longitudinal axis through the locking member, whereby said recess is disposed at an angle, when the main parts are in folded position, corresponding to the position of the switch lever when the locking member is applied to the switch and thus in its own locking position.

14. A block out for use with a switch having a front panel presented to a user, and having an actuating lever exposed through the front panel and thereby accessible for actuation by the user, and swingable on an axis adjacent to the front panel, between opposite positions spaced apart angularly, comprising, an elongated one-piece member having a portion at the middle forming a hinge and main parts on opposite sides of the hinge foldable toward each other and having front faces that are interengagable, the member being fitted to the switch by folding the parts together with the lever therebetween, and the parts having conformations in their front faces engaging the lever and thereby locking the lever against swinging movement, and the parts having interengaging elements normally locking the parts together.

15. A block out according to claim 14 wherein, the main parts engage the switch both in the same manner and held on the switch solely by means of each engaging the other and by both engaging the lever.

* * * * *